US008151715B2

(12) United States Patent
Zandona'

(10) Patent No.: US 8,151,715 B2
(45) Date of Patent: Apr. 10, 2012

(54) AUTOMATIC LOCK FOR A MOBILE STEP MECHANICALLY CONNECTED TO A DOOR IN PARTICULAR FOR A RAILWAY COACH

(75) Inventor: Luciano Zandona', Bussolengo (IT)

(73) Assignee: Faiveley Transport Italia S.p.A., Piossasco (TO) (IT)

( * ) Notice: Subject to any disclaimer, the term of this patent is extended or adjusted under 35 U.S.C. 154(b) by 865 days.

(21) Appl. No.: 11/569,479

(22) PCT Filed: May 23, 2005

(86) PCT No.: PCT/IT2005/000295

§ 371 (c)(1), (2), (4) Date: Jan. 5, 2011

(87) PCT Pub. No.: WO2005/120920

PCT Pub. Date: Dec. 22, 2005

(65) Prior Publication Data

US 2011/0088588 A1 Apr. 21, 2011

(30) Foreign Application Priority Data

May 25, 2004 (IT) ..... VR2004A0088

(51) Int. Cl.
*B61D 23/00* (2006.01)

(52) U.S. Cl. ..... 105/447; 105/443; 105/445; 105/449

(58) Field of Classification Search ..... 105/443–450; 280/163

See application file for complete search history.

(56) References Cited

U.S. PATENT DOCUMENTS 1,627,749 A * 5/1927 Rowntree ..... 105/341
2,764,422 A * 9/1956 McDonald ..... 182/91
3,887,217 A * 6/1975 Thomas ..... 280/166
4,110,673 A * 8/1978 Magy et al. ..... 318/466

(Continued)

FOREIGN PATENT DOCUMENTS

DE 840 195 5/1952

(Continued)

OTHER PUBLICATIONS

International Search Report from PCT/IT2005/000295.

*Primary Examiner* — S. Joseph Morano
*Assistant Examiner* — Jason C Smith
(74) *Attorney, Agent, or Firm* — Greenberg Traurig, LLP

(57) ABSTRACT

An automatic lock for mobile steps (15) employed to allow passengers to get on and off railway coaches, located in the lower bodywork of the coach and enclosed inside a casing (12) positioned below the bracket (13) of the fixed step (14), on the outer edge of which the mobile step (15) is hinged, and whereby said step (15) is activated by a connecting rod (18) to move from a lowered position to a raised position and visa versa. The other end of the connecting rod (18), opposite the pin coupling it to the step (15), is hinged to a carriage (19) equipped with bearings (20) which slide inside a shaped guide (21), activated by the stabilizer shaft (11) for opening/closing the railway coach doors, or by an independent unit (30), and thereby transforming the sliding of the carriage (19) into an angular movement of the step (15).

12 Claims, 6 Drawing Sheets

U.S. PATENT DOCUMENTS

| | | | | |
|---|---|---|---|---|
| 4,270,630 | A * | 6/1981 | Karkau | 187/200 |
| 5,154,125 | A * | 10/1992 | Renner et al. | 105/447 |
| 6,942,233 | B2 * | 9/2005 | Leitner et al. | 280/166 |
| 7,007,961 | B2 * | 3/2006 | Leitner et al. | 280/166 |
| 7,163,221 | B2 * | 1/2007 | Leitner | 280/166 |
| 7,367,574 | B2 * | 5/2008 | Leitner | 280/166 |
| 7,793,596 | B2 * | 9/2010 | Hirtenlehner | 105/449 |
| 2008/0250966 | A1 * | 10/2008 | Hirtenlehner | 105/444 |
| 2011/0088588 | A1 * | 4/2011 | Zandona | 105/447 |

FOREIGN PATENT DOCUMENTS

| | | |
|---|---|---|
| DE | 857 813 | 12/1952 |
| DE | 11 63 886 | 2/1964 |
| EP | 0 114 264 | 8/1984 |

* cited by examiner

SEC. A : A

SEC. B : B

AUTOMATIC LOCK FOR A MOBILE STEP MECHANICALLY CONNECTED TO A DOOR IN PARTICULAR FOR A RAILWAY COACH

This application is a national stage filing under 35 U.S.C. 371 of International Application PCT/IT2005/000295, filed on May 23, 2005, which claims the benefit of Italian Application No: VR2004 A000088, filed on May 25, 2004. The entire teachings of the referenced application is incorporated herein by reference. International Application PCT/IT2005/000295 was published under PCT Article 21(2) in English.

TECHNICAL FIELD

This invention concerns an automatic lock for a mobile step connected mechanically to a door in particular for a railway car.

More specifically, this invention refers to an automatic lock that allows a mobile step, designed to permit passengers to get on and off railway cars, to protrude from its housing on opening of the door and to retract on closing of the door, remaining within the clearance gauge of the car.

This automatic lock uses mechanisms which are simple in design but safe and efficient in terms of functioning, on one hand simplifying construction and on the other ensuring the functioning of the system while fully respecting all the safety parameters.

This invention can be applied in the field of production of components and accessories for railway vehicles, in particular devices for managing and controlling the parts for the opening/closing of these vehicles.

BACKGROUND ART

It is known that railway vehicles are equipped with doors which move by means of automatic systems, which are used more and more frequently in this sector.

Railway vehicles are also equipped with steps located at the doors, to allow passengers to get on and off the train.

In some cases, above all when the railway vehicles are particularly long, in order to respect the clearance gauges imposed by the railway regulations, mobile steps are used with traditional opening and closing mechanisms.

These known opening and closing mechanisms are generally represented in some cases by means for rotation of the step to be moved, which however present a series of problems which this invention wishes to remedy.

One problem encountered in traditional mechanisms for the rotation of mobile steps for railways cars is that their design is fairly complex and they do not guarantee the perfect stability of the step while it is moving out into the working position.

Another problem encountered in the known movement mechanisms is that they are not synchronised with the opening of the doors, and more specifically they may be synchronised but are unable to guarantee that, as required by regulations, the step moves out before the door is completely open and withdraws immediately after the door closes.

DESCRIPTION OF THE INVENTION

This Invention proposes to provide an automatic locking mechanism for a mobile step connected to a door in particular of railway cars, which is able to eliminate or at least reduce the problems described above.

The invention also proposes to provide an automatic locking mechanism for a mobile step, which is easy to produce so as to be economically advantageous.

This is achieved by means of an automatic locking mechanism for a mobile step the features of which are described in the main claim.

The dependent claims of the automatic locking mechanism for a mobile step for railway cars describe advantageous embodiments of the invention.

The main advantages of this solution, other than those due to its construction simplicity rather than the traditional complexity of known steps, concern first of all the safety aspect, guaranteeing the perfect stability of the step while it is moving out into the working position.

In addition, the quality of the mobile step according to the invention is superior, since the means for its movement are perfectly synchronised with the opening of the door, and more specifically they are able to guarantee that, as required by regulations, the step moves out before the complete opening of the door and withdraws immediately after the door closes.

The automatic lock according to the invention therefore comprises a fixed step portion whose outer edge is hinged to a mobile step portion whose movement is imparted by a kinematic motion with a drive member represented by the same stabiliser shaft that operates the opening and closing of the railway car doors.

The kinematic motion of the hinged step portion consists of a connecting rod fitted on the end of a carriage which moves alternately from a retracted position to a forward position and vice versa inside a particularly shaped guide.

The sliding movement of the carriage imparted by the door stabiliser shaft causes the movement of the connecting rod and the consequent rotation of the mobile step portion with respect to the fixed step portion on which it is hinged.

The main advantage of this movement system is that it guarantees the raising of the mobile step as soon as the respective door starts to open, so that when the door is completely open the step is already in position, preventing any possibility of injury to the passengers.

In the same way and again with the aim of preventing accidents, the system in question also guarantees that the retraction of the step takes place immediately before the complete closure of the door, ensuring that the step remains in the forward position even when the door begins to close, withdrawing into its housing at the same time as and not before the last stage of closing.

DESCRIPTION OF THE DRAWINGS

Other features and advantages of the invention will become evident on reading the following description of one embodiment of the invention, provided as a non-binding example, with the help of the accompanying drawings in which.

DESCRIPTION OF ONE EMBODIMENT OF THE INVENTION

Figures 1, 2, 3:
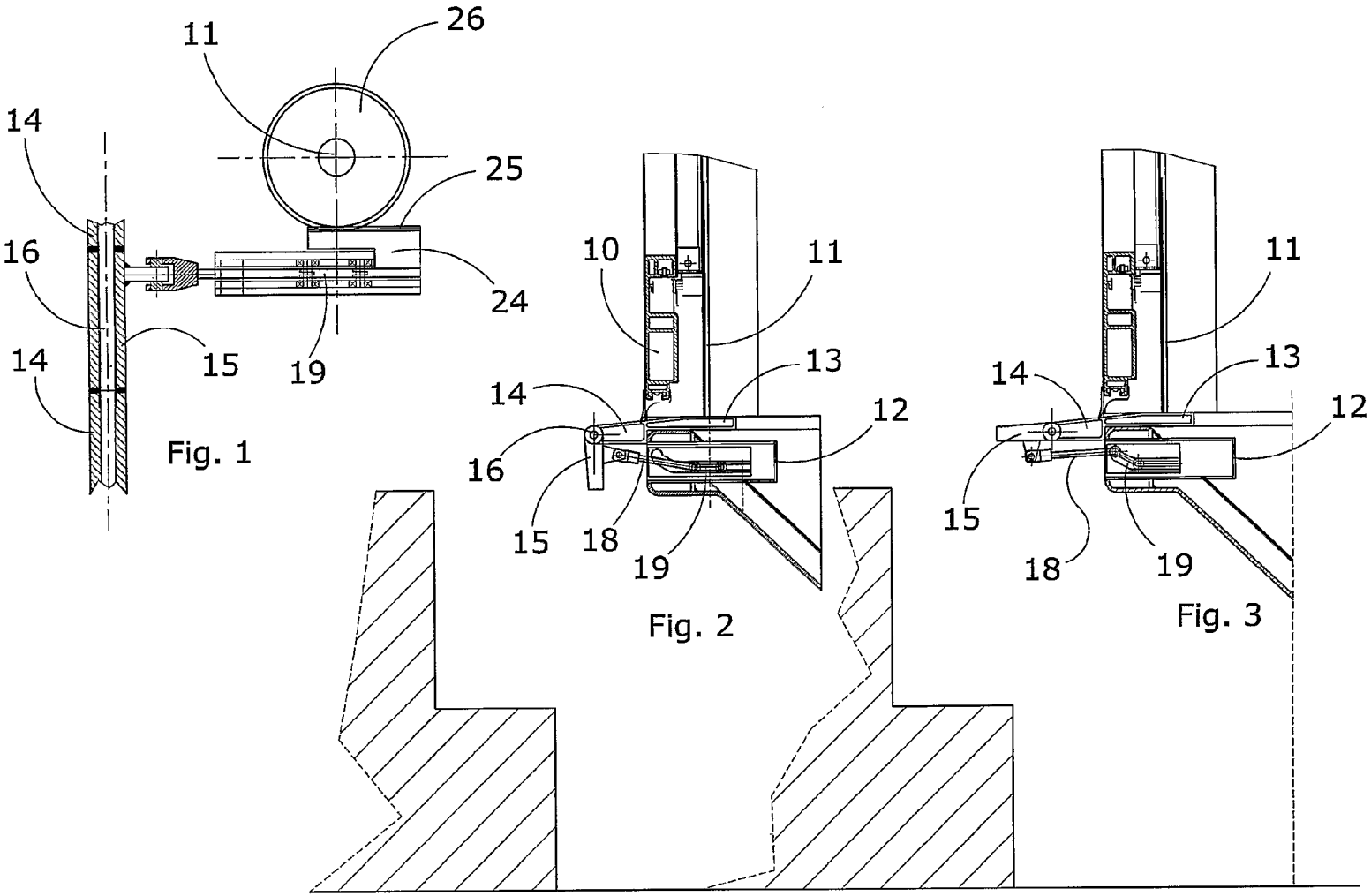
FIG. 1 represents a schematic plan view of the automatic locking mechanism for the mobile step of a railway car according to the invention as a whole.
FIG. 2 shows a schematic vertical cross-section of the door and the respective mobile step in the lowered position.
FIG. 3 shows a schematic vertical cross-section of the door and the respective mobile step in the raised position.

Referring first of all to FIGS. 2 and 3, the automatic lock according to the invention is installed close to each of the doors 10 of a railway car and below the vertical stabiliser shaft 11.

The vertical stabiliser shaft 11 represents the means designed to provide the doors with the first thrust outwards during opening and the last pull inwards during closing.

The automatic lock according to the invention is positioned in the lower bodywork of the car and is enclosed inside a protective guard 12 located below the bracket 13 of the fixed step 14, on the outer edge of which the mobile step 15 is hinged by means of an alternate sector hinge 16.

Figure 4:
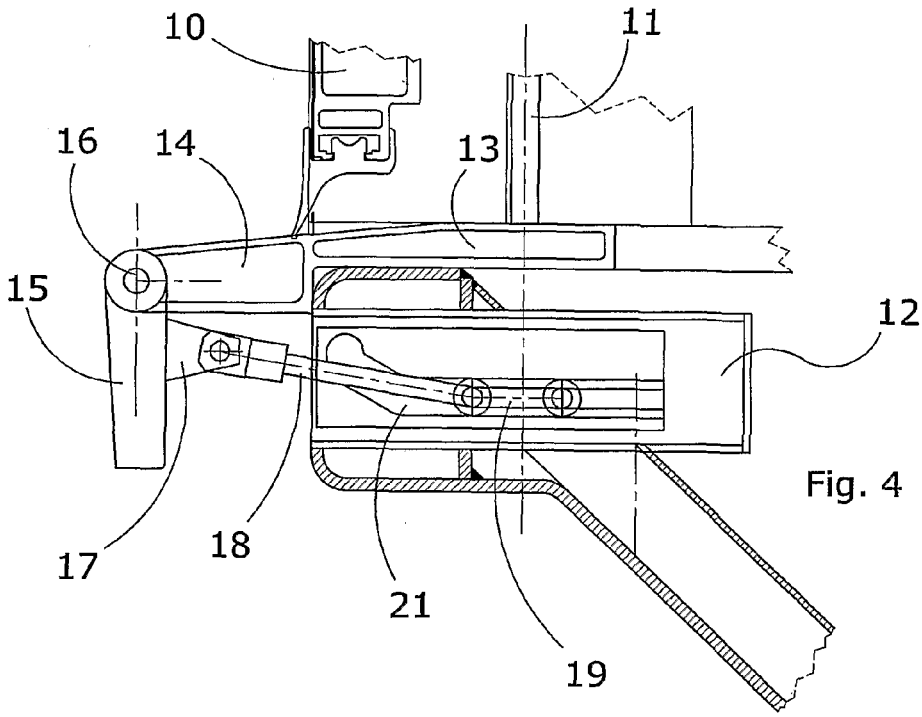
FIG. 4 is a detailed cross-section of the automatic locking mechanism of the mobile step in the lowered position.
Figure 5:
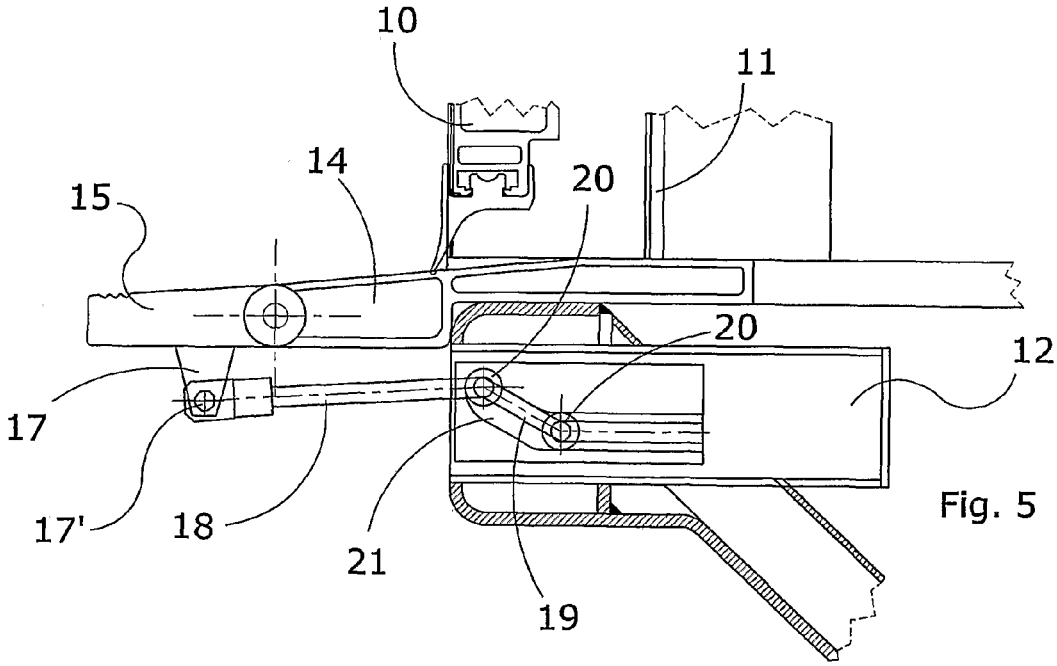
FIG. 5 is a detailed cross-section of the automatic locking mechanism of the mobile step in the raised position on a horizontal pane.
Figure 6:
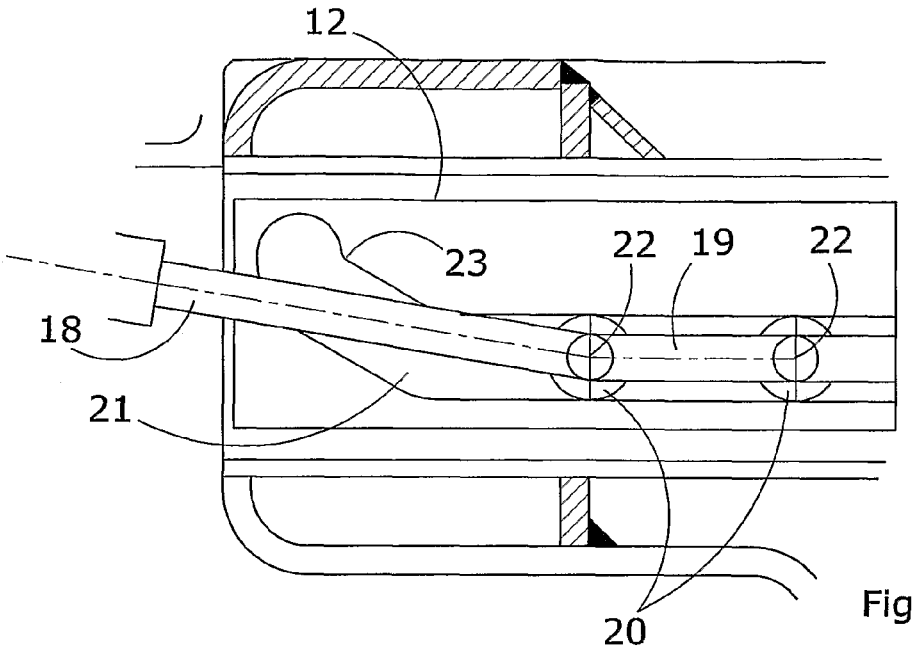
FIGS. 6 and 7 show schematic views of the parts of the guide unit in, respectively, a first and second stage of movement of the carriage designed to move the connecting rod.
Figure 7:
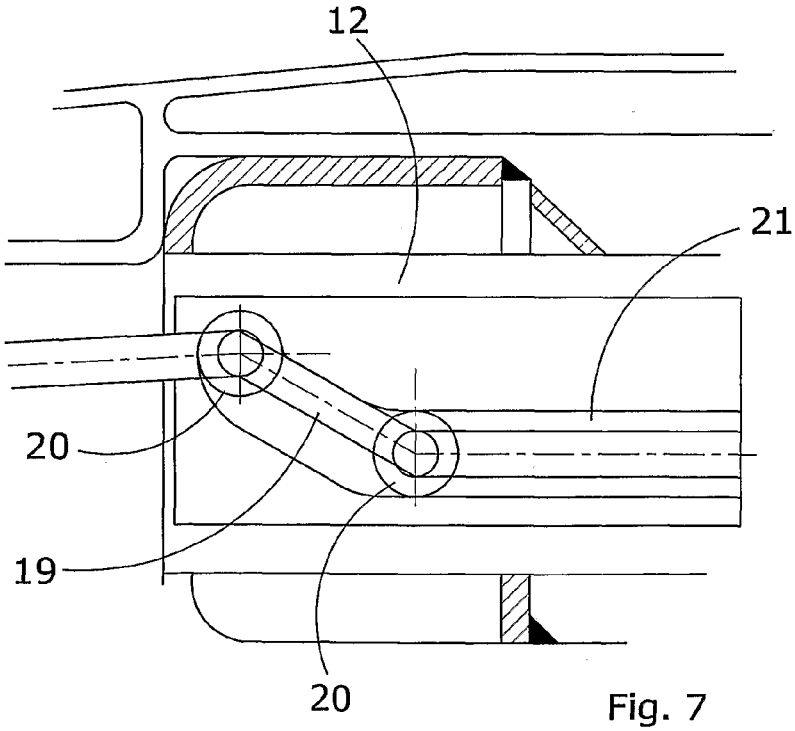

Moving on to FIGS. 4 and 5, it can be seen that below the step 15 is a bracket 17 whose end 17' is hinged to one end of a connecting rod 18.

The other end of the connecting rod 18 opposite the coupling pin of the step 15 is in turn hinged to a carriage 19, equipped with wheels 20 which slide inside a shaped guide 21.

The carriage 19 is mounted on wheels 20 consisting of pairs of ball bearings, positioned on pivots 22, whose diameter is only slightly smaller than the housing of the guide 21, in order to slide inside the guide and be held in place.

The guide 21 is shaped so that it forms a first horizontal section in the part farthest away from the coupling pin of the connecting rod 18, and a second oblique section joined to the former section with rounded corners.

The end of the oblique section of this guide 21 facing the exterior of the protective guard 12, ends with a rounded shape turned slightly upwards, so as to form a notch 23 which protrudes slightly from the oblique edge of the guide.

The connecting rod 18 is countered by elastic elements which keep the end attached to the carriage thrust upwards.

Finally, as can be seen in FIG. 1, the carriage 19 is attached to a bracket 24, which has a rack edge 25 engaging with a toothed pinion 26 which is fixed on the lower edge of the stabiliser shaft 11 designed to provide the opening thrust of the doors of the railway car, in order to start moving.

The functioning of the automatic lock is therefore as follows.

When the mobile step 15 is in the lowered, non-working position, the connecting rod 18 and the carriage 19 to which it is attached are in their most retracted position, the carriage being located in the rear part of the guide 21.

When the opening of the door 10 is activated, the stabiliser shaft 11 begins to rotate so that the doors are pushed out of their housing before, starting to translate.

In this phase, the rotation of the stabiliser shaft 11 causes a movement of the bracket 24, which, being attached to the carriage 19, in turn causes the latter to move outwards and the connecting rod 18 consequently moves the mobile step 15 upwards into a substantially horizontal position aligned with the fixed step 14.

During the maximum outward thrust phase of the carriage 19, the pair of outer wheels 20 enter the rounded section forming the end of the guide 21, and since the connecting rod 18 is held in the upward thrust position by elastic means, the pair of wheels 20 remains engaged in this part of the guide and above the notch 23, which thus represents a blocking element for the step in the opening phase.

This is due to the fact that, when the step 15 is raised, the axis of the connecting rod 18 is angled upwards by a few degrees with respect to the horizontal, considering that the vertex of this angle is located at the hinge 16 of the step, and the downward thrust of the mobile part 15 of the step imparted by the weight of the passengers is transmitted to the bearings of the carriage 19 which are positioned at the end of the connecting rod 18, and which, being pushed upwards in the end part of the guide 21 just above the notch 23, will prevent any possibility of the step giving way, keeping it instead firmly fixed in place.

Once the step has been locked in the raised position as described above, the doors can open to allow passengers to get on and off the train.

Once the flow of passengers has ended and when the train is ready to leave, the closing of the doors is activated and at the start, when the doors slide towards each other, the step remains locked in the raised position, respecting the safety criteria.

When the doors are almost in contact with each other in the closed position, the stabiliser shaft 11 is activated and turns in the opposite direction to its former movement, to allow the doors to move back into their housing, permitting the carriage 19 to return to its initial position so that the outer wheels 20 are released from the notch 23 and allow the retraction of the connecting rod and the lowering of the step 15, which returns within the clearance gauge of the railway car.

As can be noted, the raising of the mobile step is activated precisely at the start of the opening of the respective door, so that when the door is completely open the step is already in position, thus preventing the possibility of any injury to the passengers.

In the same way and again in order to prevent accidents, the system in question also guarantees that the retraction of the step takes place only just before the complete closure of the doors, guaranteeing that the step remains in the raised position even when the doors start to close, not returning to its housing until the completely closed phase.

The device activating the step, and more specifically the carriage 19, can be equipped with independent drive means which can also be synchronised with the opening/closing of the doors.

According to one embodiment, instead of being hollow and open in the shape of a slot the guide 21 can consist of a protruding or recessed track in a housing, forming a sort of rail and, being equipped with special cursors, very similar sliding movements of the carriage can be obtained without this altering the proposed invention concept.

According to another embodiment, the mechanical drive unit consists of the device shown in FIGS. 8 to 14, which allows the raising and retraction of the step 15 independently of the door opening means.

Figure 8:
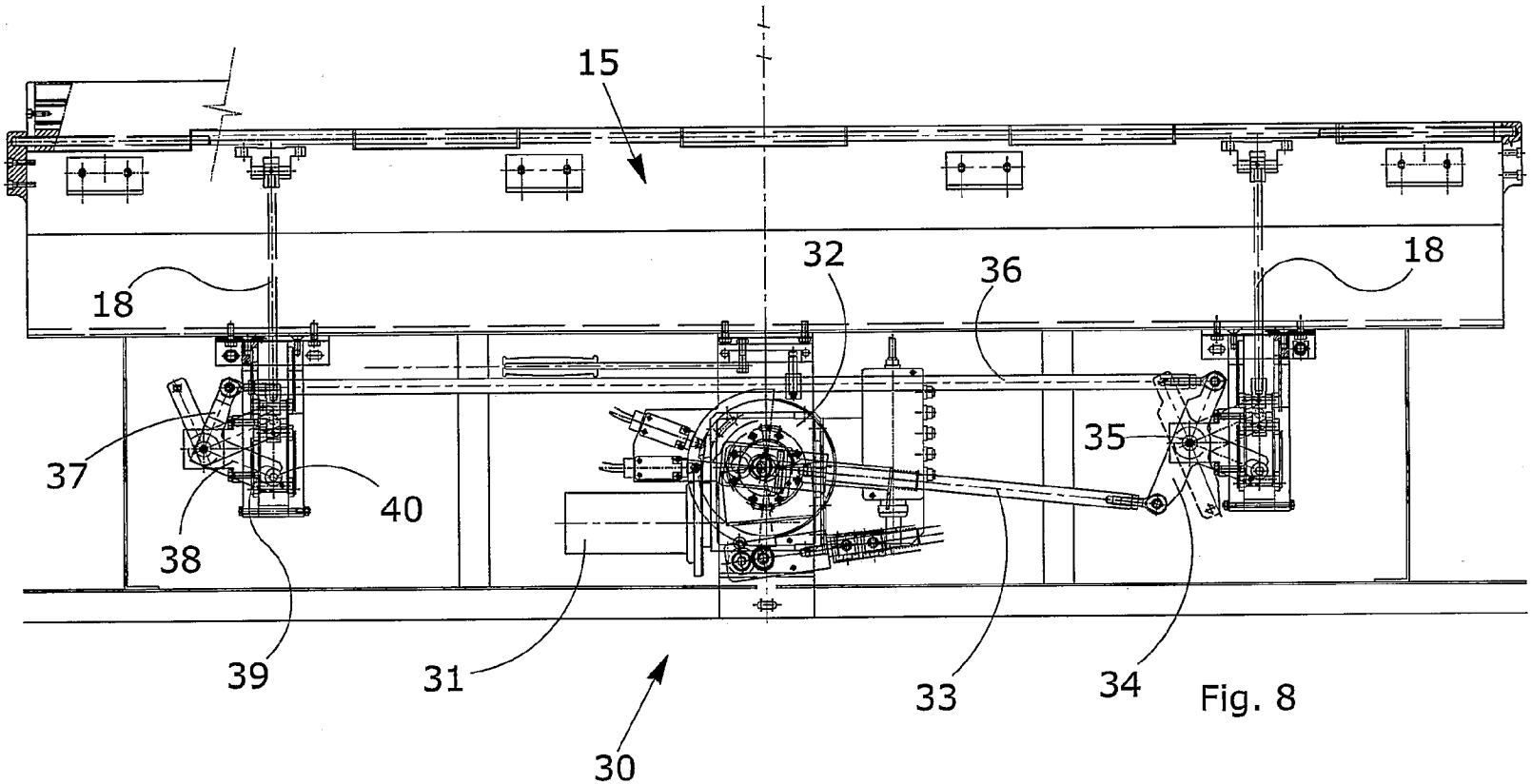
FIG. 8 is a schematic plan view of a device that allows the step to be raised and retracted independently of the door opening means.
Figure 9:
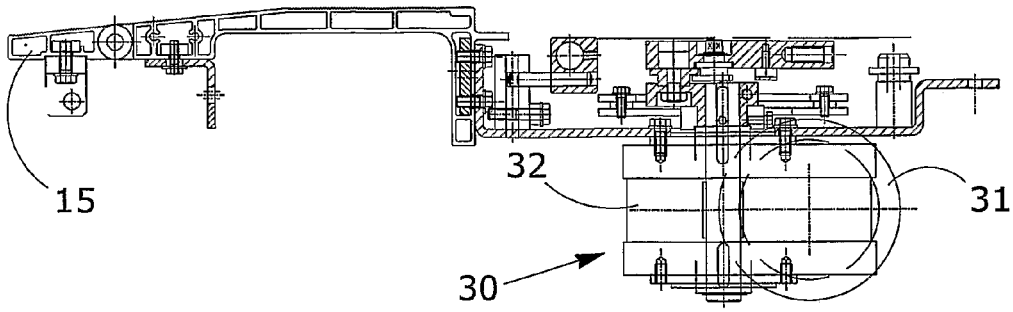
FIGS. 9 and 10 are schematic cross-section views of the device shown in FIG. 8 along the lines A-A and B-B of FIG. 14.
Figure 10:
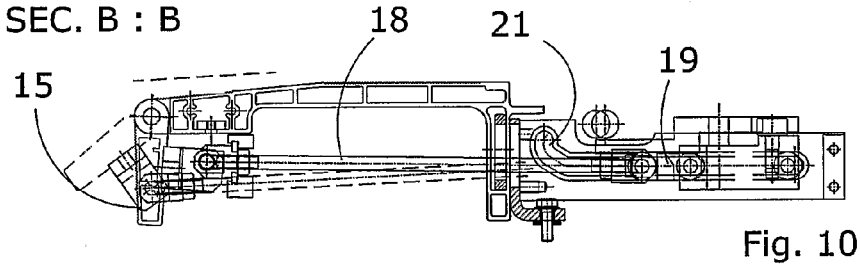
Figure 11:
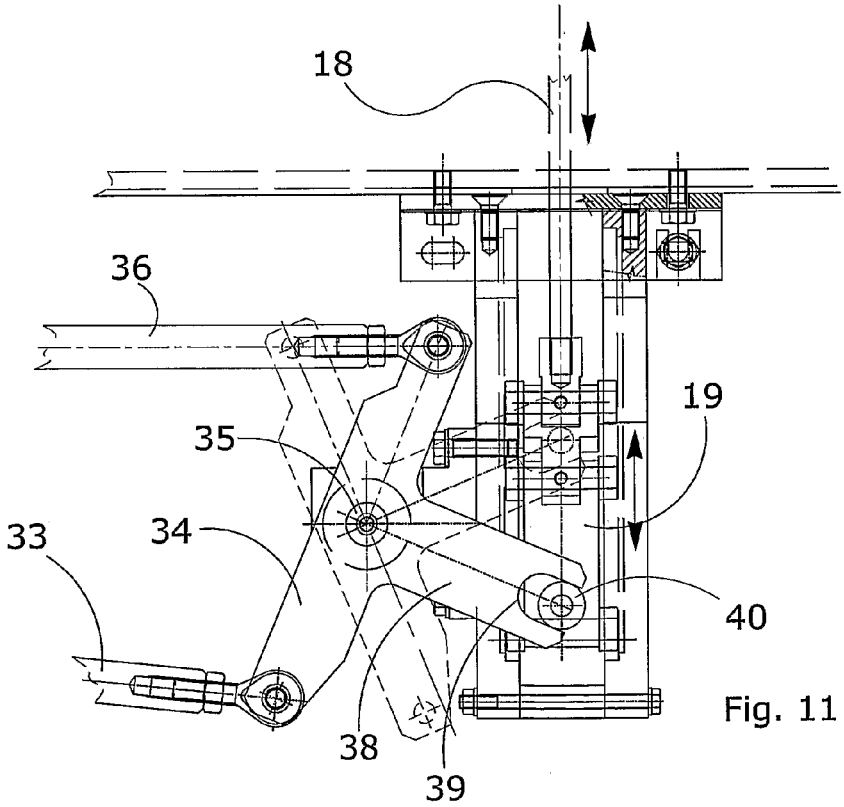
FIG. 11 shows a detailed schematic view of the drive device according to FIGS. 8 to 10.

In accordance with this last embodiment, the mechanism shown in FIG. 8 is used, indicated overall with the reference number 30, which comprises a motor 31, connected to a gear motor 32 designed to move a main tie rod 33.

The opposite end of the tie rod 33 is in turn connected to a rocker arm 34 that oscillates around a pin 35.

The other end of the rocker arm 34 opposite the one attached to the main tie rod 33 is connected to a secondary tie rod 36 which activates a second rocker arm 37.

Each of the rocker arms 34 and 37 has a central arm 38 positioned at 90° which causes the movement of the carriage 19 in the same way as described above.

More specifically, the end of the central arm 38 has a recess 39 which pushes a wheel 40 on the carriage 19 which pushes the connecting rod 18 which acts as a crank mechanism for the movement of the step 15 by means of the bracket 17 fitted on the lower part of the step itself.

In this case too, the wheels 20 of the carriage 19, pushed by the connecting rod 18, slide inside a shaped guide 21.

Figure 13:
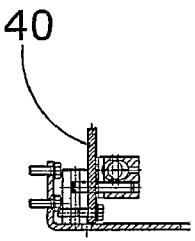
FIGS. 12 to 14 are schematic views of an emergency device which can be used in the drive system shown in FIGS. 8 to 11.
Figure 12:
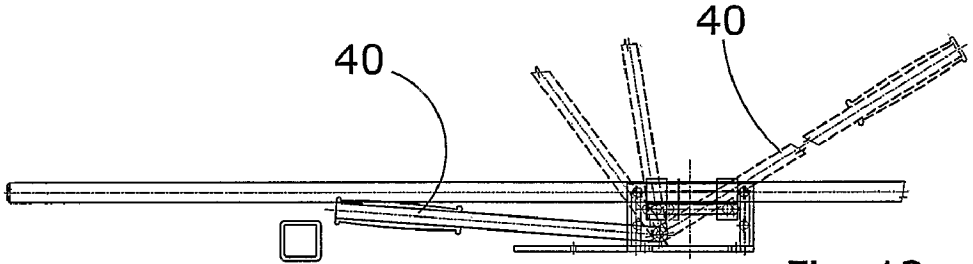
Figure 14:
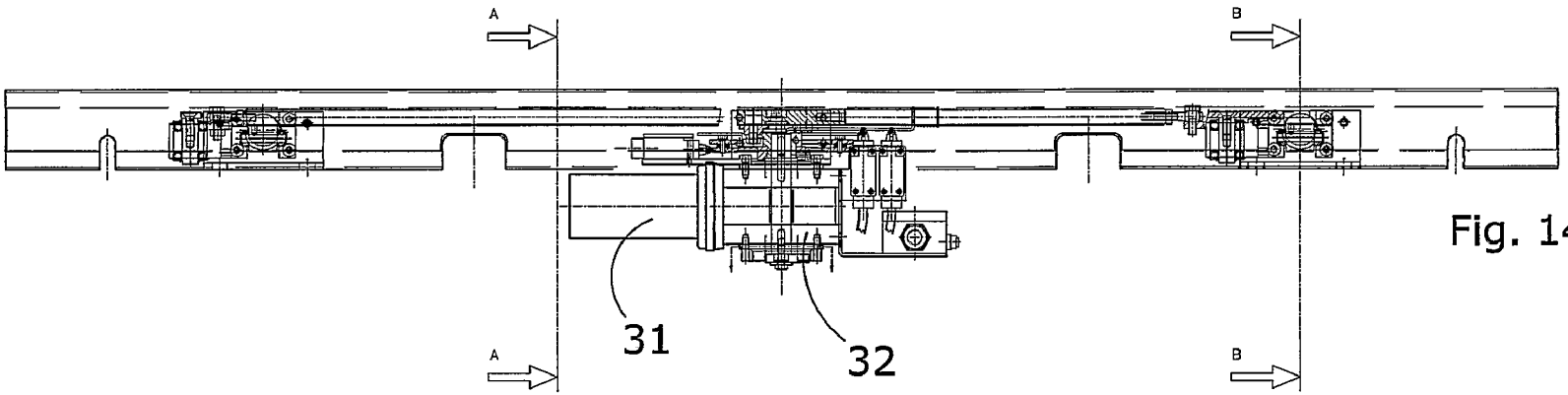

FIGS. 12, 13 and 14 show an emergency device which allows the mobile step to be manually retracted by means of a lever 40 fitted on the gear motor unit 31 and 32. When necessary or in the event of an emergency, the motor unit 31 and the gear motor 32 are uncoupled so that the lever 40 can be operated to retract the step 15.

The invention is described above with reference to a preferred embodiment. It is nevertheless clear that the invention is susceptible to numerous variations which lie within its scope, in the framework of technical equivalents.

The invention claimed is:

1. An automatic lock for a mobile step designed to allow passengers to get on and off a railway car, comprising a device located in lower bodywork of a railway car and enclosed inside a protective guard positioned below a bracket of a fixed step, on below an outer edge of which the mobile step is hinged, and in which the fixed step is activated by a connecting rod to move from a lowered position to a raised position and vice versa, wherein the end of the connecting rod, opposite below a pin coupling it to the fixed step, is in turn hinged to a carriage equipped with bearings which slide inside a shaped guide, and in that the carriage is attached to a second bracket, which is equipped with a rack edge engaging with a toothed pinion which is fixed on a lower end of a stabiliser shaft which provides the opening or closing thrust of doors of the railway car and transforms the sliding of the carriage into an angular movement of the fixed step.

2. The automatic lock of claim 1, in which the carriage is mounted on wheels or bearings whose diameter is slightly less than a housing of the guide, so as to slide inside the guide and be held in place.

3. The automatic lock of claim 1, in which the guide is shaped to present a first horizontal section in the guide part removed from the pin coupling the connecting rod, and a second oblique section of the guide.

4. The automatic lock of claim 3, in which an end of the oblique section of the guide facing an exterior of the protective guard terminates with a rounded shape turned slightly upwards, so as to form a notch which protrudes from an upper oblique edge of the guide.

5. The automatic lock of claim 1, in which the connecting rod is countered by an elastic element which keeps the end attached to the carriage; normally pushed upwards.

6. The automatic lock of claim 5, in which when the step is in the raised position, an axis of the connecting rod is at an angle upwards by a few degrees with respect to the horizontal, considering that the vertex of the angle is at a hinge of the mobile step.

7. The automatic lock of claim 1, in which the shaped guide is hollow and open, forming a shaped slot.

8. The automatic lock of claim 7, wherein the shaped guide including a protruding or recessed track inside a housing, forming a rail, while the carriage is equipped with cursors.

9. The automatic lock of claim 1, in which the carriage is equipped with an independent drive, which can be synchronised with the opening or closing of the doors.

10. The automatic lock of claim 1, further comprising a device that allows the step to be raised and retracted independently of the door opening, said device comprising a motor connected to a gear motor for operating a main tie rod to rocker arms equipped with a central arm which causes the movement of the carriage.

11. The automatic lock of claim 10, wherein the end of the central arm has a recess pushing a wheel located on the carriage which pushes the connecting rod, whereby said connecting rod acts as a crank mechanism for the movement of the step by a bracket fitted on the lower part of the step.

12. The automatic lock of claim 11, further comprising an emergency device for permitting the mobile step to be manually retracted by a lever fitted on the gear motor.

* * * * *